US005836344A

United States Patent [19]

Hovi, Sr.

[11] Patent Number: 5,836,344

[45] Date of Patent: Nov. 17, 1998

[54] SYSTEM FOR PREVENTING AND MELTING ICE DAMS

[76] Inventor: Andrew Hovi, Sr., 10 Valley View Rd., Danville, Pa. 17821

[21] Appl. No.: 762,718

[22] Filed: Dec. 10, 1996

Related U.S. Application Data

[60] Provisional application No. 60/015,483 Apr. 12, 1996.

[51] Int. Cl.[6] ..... F16K 5/00

[52] U.S. Cl. ..... 137/357; 137/338; 52/11; 165/47

[58] Field of Search ..... 137/356, 357, 137/338; 52/11; 165/47

[56] References Cited

U.S. PATENT DOCUMENTS

| | | | |
|---|---|---|---|
| 2,111,251 | 3/1938 | Spilsbury . | |
| 2,762,448 | 9/1956 | Schmid et al. . | |
| 3,935,878 | 2/1976 | Østevik . | |
| 4,010,577 | 3/1977 | Stalter . | |
| 4,043,527 | 8/1977 | Franzmeier . | |
| 4,880,051 | 11/1989 | Ohashi | 165/47 |
| 5,303,517 | 4/1994 | Schneider . | |
| 5,391,858 | 2/1995 | Tourangeau et al. . | |
| 5,531,543 | 7/1996 | Johnsen . | |

FOREIGN PATENT DOCUMENTS

| | | |
|---|---|---|
| 991934 | 6/1976 | Canada . |
| 4-228761 | 8/1992 | Japan . |

*Primary Examiner*—A. Michael Chambers
*Attorney, Agent, or Firm*—Richard C. Litman

[57] ABSTRACT

An ice dam preventing or melting system relocates warm air from the interior of a building to the eaves of a roof allowing the melting of snow and ice and/or preventing the freezing of ice along the roof edge. The system uses the warm air from the interior of the building by pumping the warm air from the interior of the building to a heat conductive edge member. The edge member dissipates the heat from the warm air to the accumulated ice and snow, causing the ice and snow to melt and leading any runoff water into the gutter. The system utilizes an edge member disposed to be secured to the roof edge which is configured to avoid water and ice backup onto any portions thereof. The system provides an aesthetically appealing addition to any new or existing building.

20 Claims, 4 Drawing Sheets

SYSTEM FOR PREVENTING AND MELTING ICE DAMS

CROSS-REFERENCE TO RELATED APPLICATIONS

This application claims the benefit of U.S. Provisional Application No. 60/015,483, filed Apr. 12, 1996.

BACKGROUND OF THE INVENTION

1. Field of the Invention

The present invention relates to a system for preventing and melting ice dams along roof eaves and gutters. The invention is especially, but not exclusively, advantageous in preventing gutter clogging and backup due to ice and snow, thereby diminishing the possibilities of water damage to the roof and the interior of a structure.

2. Description of the Prior Art

An ice dam generally forms along the edge of a roof, possibly in conjunction with a gutter which extends along the roof eaves, or simply at the eaves of a roof. This phenomenon occurs more often in northern climates where snowfall commonly accumulates on the roof. Routinely, heated air within the dwelling rises to the upper stories, and via conduction and convection causes the roof to warm. The warming of the roof and the gutters, together with the action of the sun, cause snow slowly to melt. However, at night when the temperature drops, the water and melting snow re-freeze. The daily repetition of this process results in a successive increase in the volume of ice which forms along the edge of the roof. During the cyclical melting and freezing process, an accumulation of ice blocks normal runoff flow by forming an ice dam, which typically includes cornices and icicles.

The presence of an ice dam may pose several problems. First, the blockage of normal runoff may cause water to creep under the shingles and penetrate the dwelling, thereby causing damage to the roof and the interior of the dwelling. Second, the presence of the icicles and snow cornices overhanging the edge of the roof or gutter is extremely dangerous to passersby, who may be struck and seriously or fatally injured by falling ice and snow dislodged from the roof.

Many attempts have been made to eliminate the problem of ice dams and snow cornices to little or no avail. For instance, U.S. Pat. No. 2,111,251, issued Mar. 15, 1938, to Spilsbury, discloses an arrangement providing a heating element along the overhanging portions of roof structures for melting icicles. U.S. Pat. No. 2,762,448, issued Sept. 11, 1956, to Schmid et al., discloses a system for providing steam heat to a roof drain in order to prevent the drain from clogging due to the freezing of water therein. U.S. Pat. No. 3,935,878, issued Feb. 3, 1976 , to Ostevik, discloses an arrangement for introducing heated air to a water drainage gully in order to avoid accumulation of ice and snow therein which may clog the gully and interfere with water drainage. U.S. Pat. No. 4,010,557, issued Mar. 8, 1977, to Stalter, discloses a roof drain system that disrupts water flowing from the roof into droplets and distributes the droplets in a relatively wide band and outwardly of the building. U.S. Pat. No. 4,043,527, issued Aug. 23, 1977, to Franzmeier, discloses heating cables used along rooftops and inside gutters for melting the snow and ice that has accumulated. U.S. Pat. No. 5,303,517, issued Apr. 19, 1994, to Schneider, discloses a non-residential interior roof gutter system where storm water flows to low elevation perimeter walls. U.S. Pat. No. 5,391,858, issued Feb. 21, 1995, to Tourangeau et al., discloses an ice dam melting system that uses a heat cell which is placed on a roof. The heat cell generally is formed of an upper metal panel, a lower panel, and a conduit intermediate the panels which houses an electrically resistive heating cable. U.S. Pat. No. 5,531,543, issued on Jul. 2, 1996, to Johnsen discloses a system for melting ice formations on flat roofs which utilize gully-type rainwater outlets. The system utilizes a thermostatically controlled heating cable within a radial array of closed-top channels centered over and about a gully downpipe.

Canadian Patent Document No. 991,934, issued Jun. 29, 1976, to Adamic, discloses a device for melting ice dams that utilizes hot exhaust fumes siphoned from a chimney and channeled along the edges (or eaves) of the roof. Japanese Patent Document No. 04-228761, issued Aug. 18, 1992, to Yanagi, discloses a system for preventing the buildup of ice and snow by venting warm air from the interior of a house through the eaves and into a channeling duct formed in the gutter, along the roof eaves and finally expelling the air from the duct via a ventilating mechanism.

None of the above inventions and patents seem to properly address the problems arising from the formation of ice dams and snow cornices. Moreover, none of the above references, taken either singly or in combination, is seen to describe the instant invention as claimed.

SUMMARY OF THE INVENTION

The ice dam preventing or melting system of the present invention relocates warm air from the interior of a building to the edge of a roof to melt snow and ice, and/or prevent formation of ice along the edge of the roof. The system includes a plurality of edge members securable along the edge of the roof of the building, conduit for transferring warm air between the interior of the building and the edge member, and a pump mechanism for forcing warm air to the edge member.

Each of the edge members is formed of a heat conductive material, and each has an upper portion which is securable to the roof structure and an integrally depending lower configured portion. The upper portion is substantially planar to encourage water runoff, whereas the lower portion is configured so that it has a shape defining an elongate channel that opens downwardly while the upper portion is secured to the roof of the building. In each channel of each edge member is a conduit having a plurality of exhaust ports for expelling the warm air conducted therein. To support the edge members, each edge member is provided with a plurality of spaced reinforcing ribs adjacent the opening of the channel, as well as a foam type material and underlying support structure. The reinforcing ribs maintain the structure of the edge member along the opening of the channel, whereas the foam type material and the underlying support structure support the upper portion of the edge member.

Beneath the roof (preferably in an attic), a system of solid conduit is provided for transferring warm air from the interior of the building to the conduit having exhaust ports (those located within the elongate channels of the edge members). The pumps extract warm air from the interior of the building and force the warm air through the exhaust ports of the conduit located in the channels of the edge member. The warm air expelled into the channel warms each edge member to cause melting of any ice and snow thereon. The resulting water runoff flows off each edge member by flowing over the upper portion and downwardly over an upper lip of the channel which is formed intermediate the upper portion and the channel. The upper lip causes water to flow off the edge member without flowing into the channel. Furthermore, because the channel opens downwardly, any ice or snow collected therein will melt and flow out of the channel and downwardly over a lower lip which is formed opposite the upper lip thereof.

To maintain fluid communication between the transfer (solid) conduit and the interior of the building, an air transfer unit is provided on the interior structure. The air transfer unit includes an upper portion and a lower portion which are connected together through the interior structure (i.e., a ceiling or wall) of the building, thereby maintaining fluid communication with the interior of the building. The lower portion thereof contains filtration means for filtering particulate matter from the warm fluid extracted from the interior of the building by the pump, and a manually operable valve for opening and closing communication between the transfer conduit and the interior of the building.

Accordingly, it is a principal object of the invention to provide a system for preventing and/or melting ice dams which may be easily installed, either as a retrofit or on new construction.

It is another object of the invention to provide a system which effectively prevents the formation of an ice dam on a roof, and which will melt an already formed ice dam.

Yet another object of the invention is to provide a system for preventing and/or melting ice dams whose roof edge element is configured so as to avoid water and ice backup onto any portion thereof.

It is a further object of the invention to provide a system for preventing and/or melting ice dams that is aesthetically pleasing and which will not be damaged by the presence of large amounts of ice and snow.

Still another object of the invention is to overcome the disadvantages of the prior art ice dam melting devices.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a system for preventing the formation of ice dams and the buildup of ice and snow along the edges of building roofs. The system of the present invention can be fitted onto the roof of an existing building or incorporated into the roof structure during construction of a new building.

Figure 1:
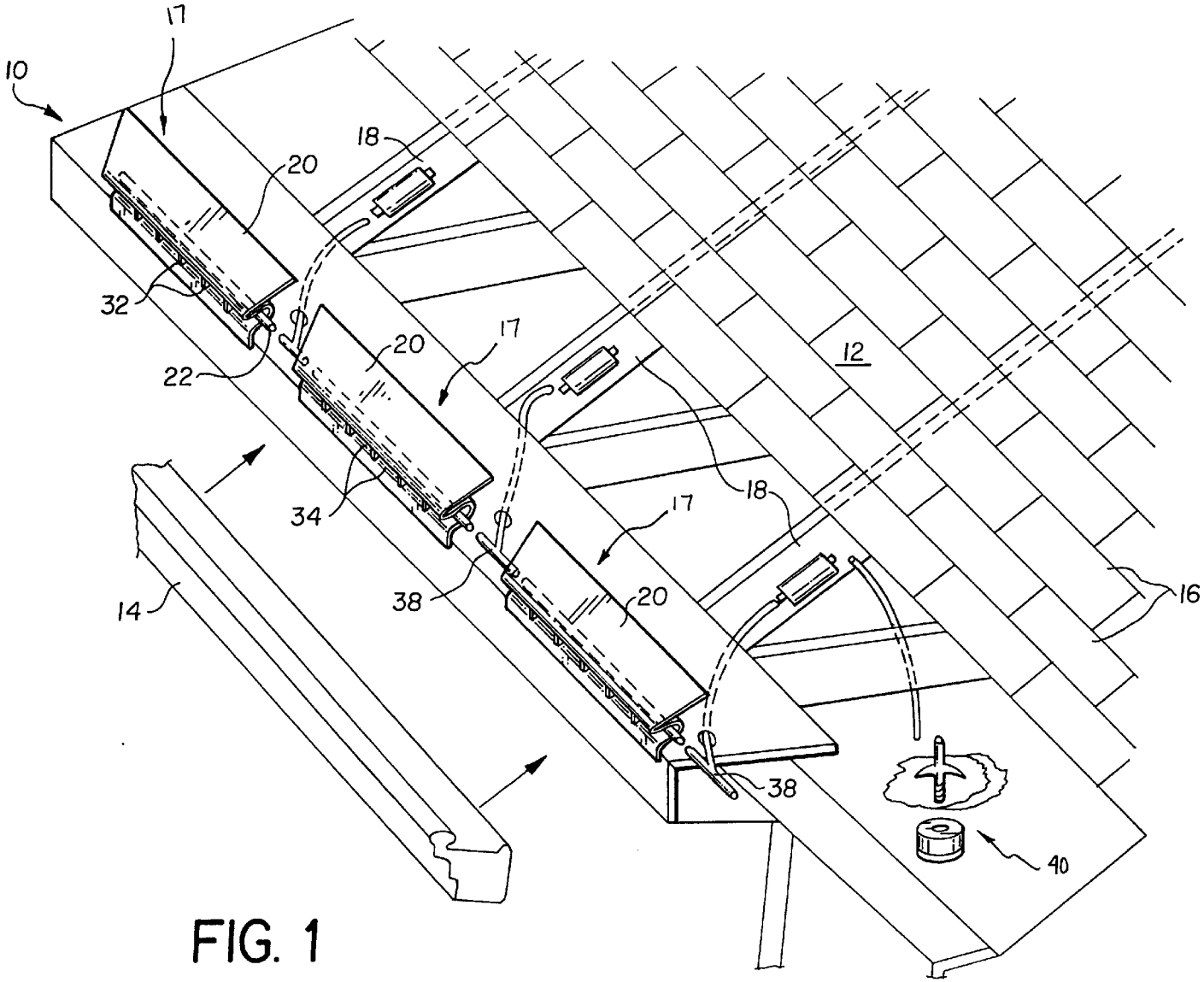
FIG. 1 is an exploded environmental, partial perspective view of the invention shown along the eaves of a roof.

Referring now to the figures by numerals of reference and first to FIG. 1, 10 denotes generally the system of the present invention, which is shown installed on a building such as a home. In this figure, a roof 12 is only partially shown in order to facilitate a complete understanding of the invention. Anchored to a base surface of the roof 12 (i.e., plywood sheets) are a multiplicity of shingles 16 that form a building's first protective barrier from precipitation and wind. Along the edge of the roof, namely an eave, a gutter 14 is placed for directing and carrying fluent materials from the roof 12 to a downspout (not shown) or any other distributor of the type conventionally known in the art.

The system 10 of the present invention comprises a multiplicity of cooperating parts, including an edge member 17, a conduit 22 for conducting warm air between the interior of a building and the edge member, and a pump mechanism 50 for forcing warm air to the edge member.

Figure 2:
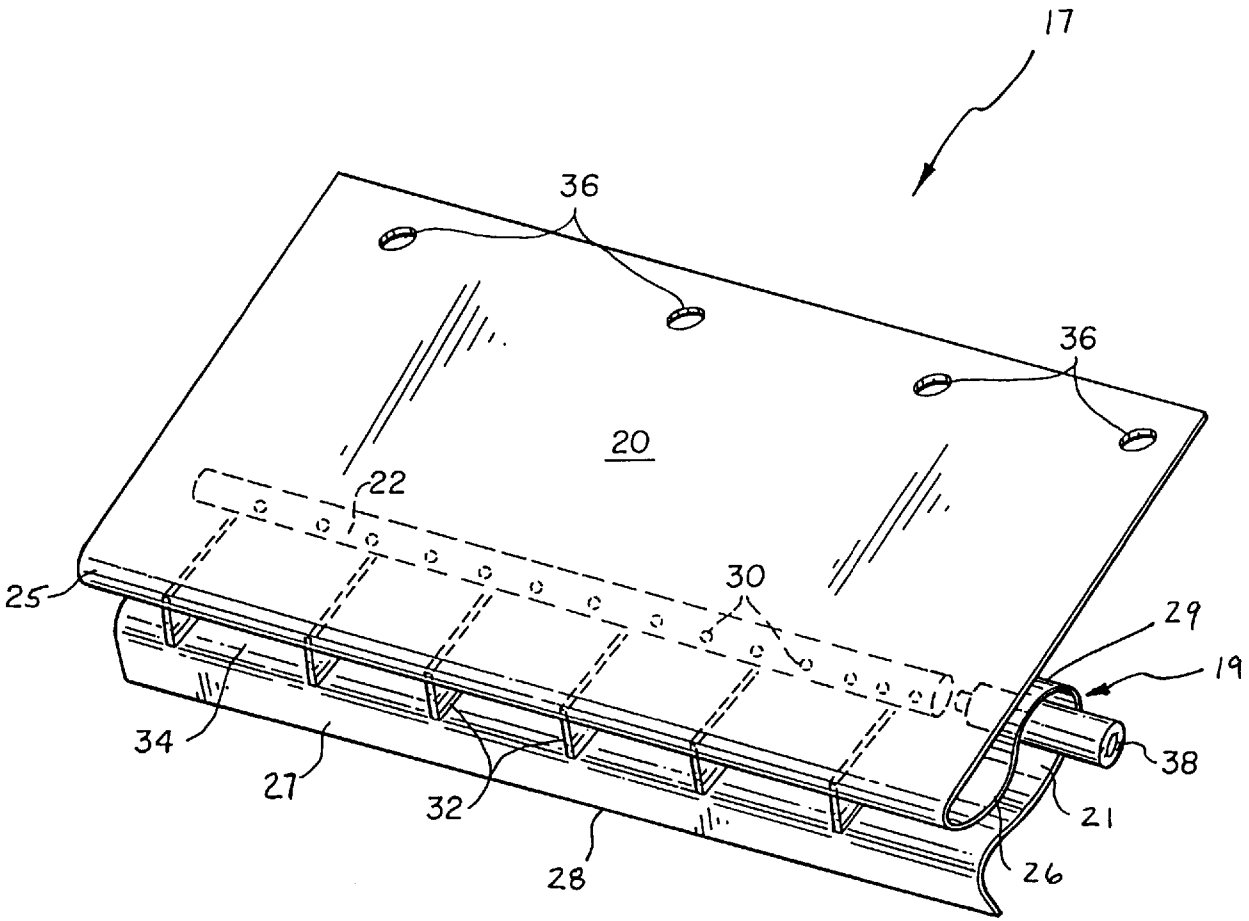
FIG. 2 is a perspective view of a single unitary member of the invention.
Figure 3:
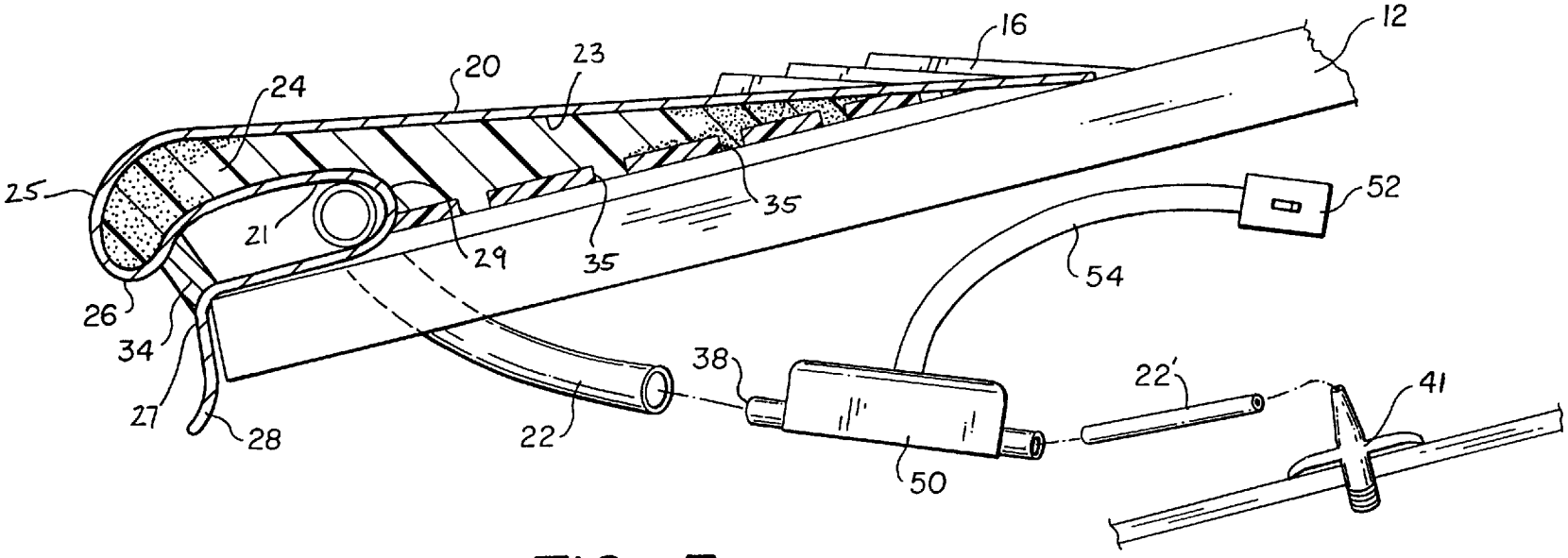
FIG. 3 is an expanded side environmental view of the present invention.

Referring now to FIGS. 1 and 2, the edge member 17 is attached to the eave of the roof for conducting heat to the ice dam or buildup of snow and ice, and assisting in the runoff of water. The edge member 17 preferably is formed of a heat conductive metallic material such as aluminum, tin, copper, or the like. It should be apparent, however, that other metal elements or compounds may be used to form the edge member. Referring specifically now to FIGS. 2 and 3, the edge member 17 includes a relatively planar upper portion 20 and a configured lower portion generally denoted as 19. The upper portion 20 has adjacent its upper end a plurality of nail holes 36 through which roofing nails or the like may be used to secure or otherwise anchor the edge member to the roof. Before securing the edge member 17 to the roof, the edge member should be positioned so that its configured lower portion 19 lies above and abuts against the eave (edge) of the roof. The configured lower portion 19 is folded beneath the upper portion 20 and is shaped to include a channel 21, an first lip 25 intermediate the channel and the upper portion, and a second lip 27 that extends downwardly from the channel. When the edge member 17 is properly anchored to the roof 12, its second lip 27 is positioned over the fascia of the eave and its channel is positioned above the edge of the roof so that the channel opens downwardly (i.e., towards the gutter).

The channel 21 is disposed to receive along its length a fluid conducting member, such as flexible conduit 22 or the like, which carries warm air into the channel of the edge member 17. Each conduit 22 is provided along its length with a plurality of exhaust ports 30. The exhaust ports release warm air into the channel for the purpose of melting the ice dam or snow and ice buildup, as described more fully hereinafter.

Because the channel opens downwardly, runoff from melting ice or snow present in the channel will flow out of the channel and over the second lip 27. The second lip 27 extends generally vertically downwardly so as to encourage water runoff. A terminal end 28 of the second lip is curved outwardly in a direction away from the eave and walls of the building structure, which directs runoff into the accompanying gutter. The first lip 25 slopes downwardly from the upper portion above and a lowermost tip 26 thereon is formed so that as the system 10 melts any snow or ice, any runoff flows or drips into the gutter 14 without entering the channel. This allows the edge member to operate effectively by reducing the likelihood of ice buildup in the channel during periods of system nonuse.

Referring now to FIGS. 1–3, the edge member 17 is shown provided with several features which cooperate to maintain its form under the significant weight of snow and ice. Positioned in the first channel adjacent its opening are a plurality of spaced reinforcing rib elements 32. The rib elements 32 serve the function of providing support for the first lip 25 so as to maintain the shape of edge member 17 and to maintain the structure of channel 21. By maintaining the shape of edge member 17, the rib elements guarantee continued fluid flow into the gutter 14. In addition, the region beneath the upper portion 20 and internal to the first lip 25 is supported by a shape maintaining, foam type material 24. The foam type material is preferably a high density styrofoam, which provides both structural support and insulating capability.

The foam type material 24 maintains the shape of the edge member 17 when the ice dams begin to buildup on the roof 12. Specifically, the foam type material 24 is provided beneath a bottom side 23 of the upper portion 20 and internal to the first lip 25. The foam type material supports the upper portion 20 to minimize its sagging and to prevent it from collapsing under the weight of an ice dam or significant snow and ice buildup. Sagging or collapsing of the upper portion could result in pooling of any runoff, which could eventually result in damage to the roof 12 and the building. To maintain the integrity of the foam type material, a support structure 35 is provided beneath the foam type material. The support structure 35 extends between an external side 29 of the channel 21 and a position adjacent the upper edge of the upper portion 20. The support structure 35 is connected to the edge member using any conventional means, such as spot welding or soldering. The placement of the support structure 35 beneath the foam type material ensures support over the entire length of the upper portion 20, which as described above is critical to prevent pooling of runoff. The support structure may comprise either a grill-type structure, a plurality of spaced ribs, or any other arrangement which adequately supports the foam-type material 24.

Referring specifically now to FIGS. 1 and 3, a filter element 34 is preferably placed in the channel 21 to prevent airborne particulate materials, insects and birds from entering the channel and possibly clogging the ports 30. The filter element 34 may be formed as plural segments spaced between the rib elements 32, or as a single length unit which extends the entire length of the channel. The filter element is preferably rigid enough to withstand both momentary and prolonged effects of weather (i.e, a metal mesh or screen), and it should have a screen size sufficient to allow for the flow of warm air from the exhaust ports 30.

As seen in FIGS. 1 and 3, the system has a number of edge members 17 with conduit 22 positioned within the channel. Edge members 17 may be positioned in a spaced relationship as shown, or they may be coupled together at the ends thereof as conventionally known in the art. Conduit 22 is coupled together in a tandem arrangement by connecting tube joints 38. The joints 38 are commercially available in a variety of shapes (i.e., tee, elbow, straight, etc.); as shown in the figures, however, joints 38 are generally straight or tee-shaped.

To force air through the conduit 22, the conduit is connected in fluid communication with fluid transfer means that transfer fluid from the interior of the building to the conduit. The fluid transfer means generally comprises a pump 50 and a network of conduit 22' communicating with a warm air source, such as the interior of the building. The system 10 may use a single pump 50 or a plurality of pumps 50 depending upon the size of the building serviced by the system 10. One or more pumps 50 extract warm air from the interior of the building by drawing warm air from the building interior via the network of conduit 22' and the air transfer unit 40 (or units 40), which preferably is positioned in a ceiling of the building interior. The conduit 22' is characterized by the absence of exhaust ports 30, thus it merely conducts warm air toward the pump. The pump 50 should be positioned in an attic or other region of the building just below the roof 12, and preferably pump 50 is attached to a rafter 18 which supports roof 12. Pump 50 operates by standard electricity and thus, is controlled by an electrical switch 52. Switch 52 is preferably a standard on-off switch, however, it is conceivable to utilize various other types of control switches. For example, switch 52 may embody a timer type switch, a temperature responsive type switch, or even a sensor type switch (responsive to the amount of ice on the roof). Electrical lines 54 represent the conventional electrical connections known in the art.

Figure 4:
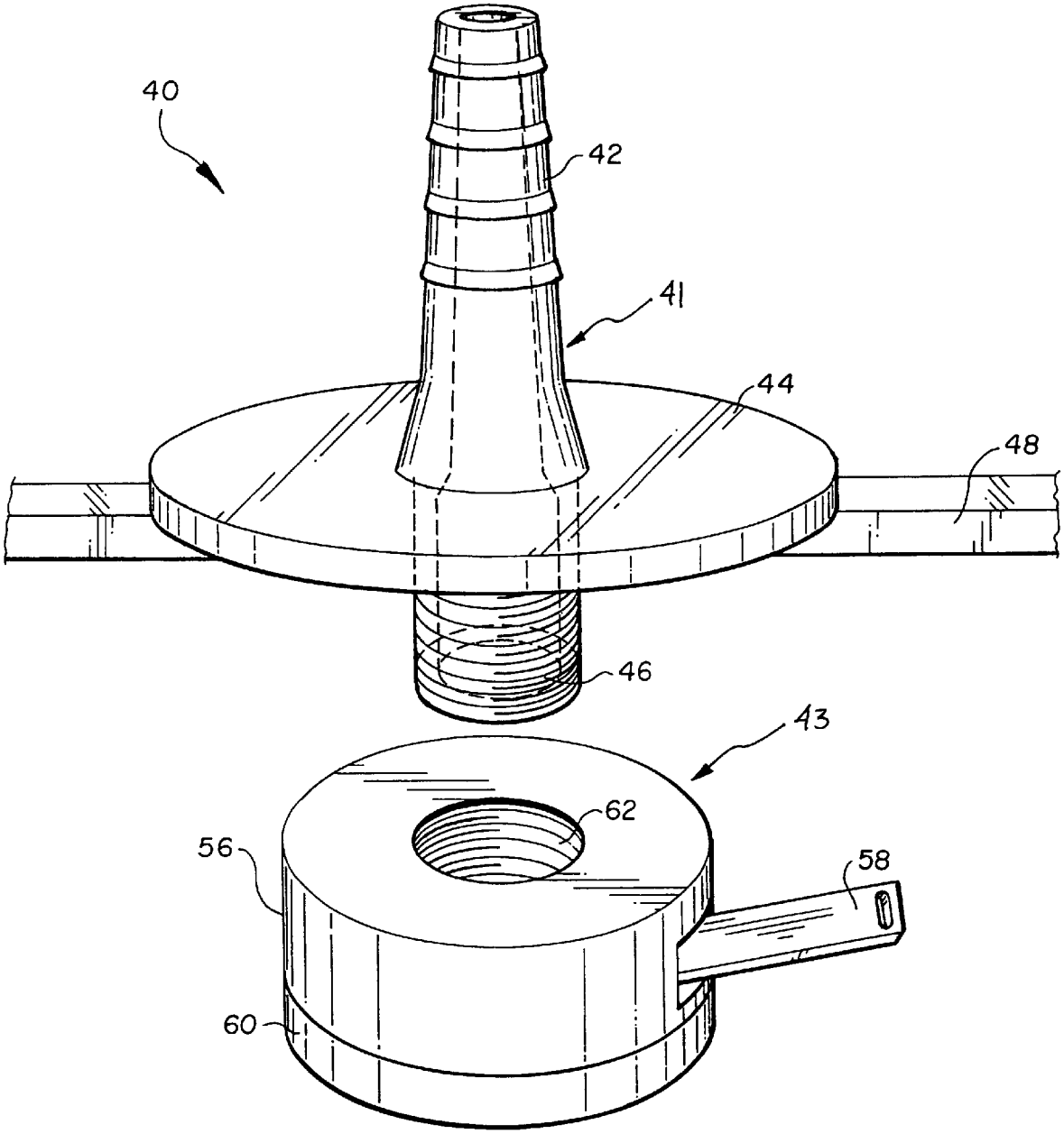
FIG. 4 is an exploded perspective view of the air transfer unit of the present invention.

Referring specifically now to FIG. 4, the air transfer unit 40 is shown in detail. The air transfer unit 40 is disposed for mounting in an interior ceiling 48 of the building. The air transfer unit has two primary parts, namely an upper or first portion 41 and a lower or second portion 43. The two parts are joined to form the holding mechanism for maintaining the position of the air transfer unit in the ceiling 48. The upper portion consists mainly of a nozzle or spout 42 having circumferentially raised ribs for inserting into and holding an end of the conduit 22'. The upper portion also has a male threaded portion 46 that extends below the nozzle 42. The male threaded portion 46 is positioned in an aperture (not shown) of ceiling 48 sized to receive the threaded portion 46. To keep the upper portion from falling through the aperture of ceiling 48, a base 44 is provided on the upper portion. The base has a diameter greater than the diameter of the aperture and male threaded portion 46. The lower portion of the air transfer unit has a generally cylindrically shaped body 56 having a diameter also greater than the diameter of the aperture of ceiling 48. The lower portion has a female threaded portion 62 that mates with the male threaded portion 46 of the upper portion. When completely engaged the upper and lower portions hold and maintain the air transfer unit 40 in the aperture of ceiling 48. The body 56 has a conventional open/close valve that is actuated by stem 58. In addition, the body 56 carries a removable or replaceable filter 60 for capturing excessive airborne particulate matter before the warm air enters the system, thereby minimizing the likelihood of such matter fouling the pump 50 or clogging the ports 30.

Upon installation of the system 10 in a building, albeit an existing or new construction, the operation is easily seen and understood. Warm air is extracted from the interior of the building via the air transfer unit 40 mounted on an interior ceiling 48. The extraction is accomplished by way of the pump 50 which, under control of switch 52, draws warm air from the interior of the building through conduit 22' and forces the warm air through the conduit 22 where it is expelled through exhaust ports 30. Warm air is expelled into the channel where it warms the heat conductive edge members 17. The warm edge members 17 conduct heat around the tip 26 and under any ice accumulation on the upper portion 20. Once the warmth of the edge member reaches the accumulated ice, the ice thereon begins to melt (or is prevented from forming in the first place) and the water runs off into the gutter 14. Additionally, as the edge member 17 conducts heat around the tip 26, the foam-type material 24 absorbs and helps distribute the warmth to the entire portion of edge member 17 under the accumulation of ice. In addition, as an energy conserving aspect, the warm air pumped from the interior to the exterior of a building by system 10 is aided by solar heat which also is collected by the edge members 17. The foam-type member 24 is thus used as a heat energy collector by absorbing and redistributing the solar heat gathered by exposed portions of the edge members 17.

While the invention has been illustrated and described in detail in the drawings and foregoing description, the same is to be considered as illustrative and not restrictive in character and scope. For instance, the air transfer unit 40 may be omitted and the warm air may be extracted from another warm air source, such as the building heating system. In addition, it is within the spirit and scope of the present invention to couple the ends of the edge members 17, thereby forming a single unitary member. Likewise, flexible tubing has been described; it is understood, however, that duct work, semi-rigid, or rigid conduit are alternative means of transporting the warm air. Finally, the upper portion 20 of the edge member need not be planar, but instead the upper portion may also be waffled or otherwise provided with ridges and gullies of the type disposed to aid the transport of runoff from the edge of the roof.

It is to be understood that the present invention is not limited to the embodiments described above, but encompasses any and all embodiments within the scope of the following claims.

I claim:

1. A system for preventing the formation of ice dams and the buildup of ice and snow along the roof edge of a building of the type having a warm fluid source, the system comprising:

a plurality of edge members securable along the edge of the roof of the building, each of said edge members being formed of a heat conductive material and each of said edge member having a shape defining an elongate channel that opens downwardly while said edge member is secured to the roof of the building;

a fluid conducting member positioned in said channel of each said edge member, said fluid conducting member having a plurality of ports for expelling the fluid conducted therein;

first support means on each said edge member for supporting each said edge member under weight of the snow and ice; and fluid transfer means, communicating between the warm fluid source and each said fluid conducting member, for transferring the warm fluid from the warm fluid source to each said fluid conducting member;

wherein said ports of each said fluid conducting member expel the warm fluid into said channel, warming each said edge member to cause the ice dams and the snow and ice buildup thereon to melt, whereby the resulting water runoff flows off each said edge member.

2. The system according to claim 1, wherein each of said edge members comprises:

an upper portion securable to the roof of the building; and a lower portion integrally depending from said upper portion, said lower portion being configured to define said channel.

3. The system according to claim 2, wherein said upper portion is substantially planar.

4. The system according to claim 2, wherein said lower portion further includes a first lip formed at one side of said channel intermediate said channel and said upper portion, said first lip having a tip that extends downwardly while said edge member is secured to the roof of the building.

5. The system according to claim 4, wherein said tip extends below the opening of said channel.

6. The system according to claim 4, wherein said lower portion further includes a second lip formed at the other side of said channel, said second lip extending downwardly to a terminal end.

7. The system according to claim 1, wherein said plurality of said edge members is spaced apart along the roof edge.

8. The system according to claim 1, wherein said plurality of said edge members is connected together along the roof edge.

9. The system according to claim 1, wherein said first support means comprises a plurality of spaced reinforcing ribs, each said reinforcing rib extending between said first lip and said second lip at the opening of said channel.

10. The system according to claim 9, further comprising a plurality of filter elements intermediate said reinforcing ribs and secured within the opening of said channel.

11. The system according to claim 9, further comprising second support means for supporting said each said edge member under weight of the snow and ice, said second support means comprising:

a foam type material located beneath said upper portion and internal to said first lip; and a support structure positioned beneath said foam type material and extending between an external side of said channel and a bottom side of said upper portion.

12. The system according to claim 11, wherein said foam type material is a high density styrene foam.

13. The system according to claim 1, wherein said fluid transfer means comprises:

at least one pump communicating with said fluid conducting member of each said edge member;

pump control means for controlling operation of said at least one pump; and conduit communicating between said at least one pump and the warm fluid source;

whereby operation of said pump control means causing said at least one pump to extract the warm fluid from the warm fluid source and deliver the warm fluid to said fluid conducting member of each said edge member.

14. The system according to claim 13, wherein said conduit communicates between said at least one pump and the interior of the building, said fluid transfer means further comprising:

an air transfer unit securable to the interior structure of the building and connected in fluid communication with said conduit, said air transfer unit maintaining said conduit in fluid communication with the interior of the building.

15. The system according to claim 14, wherein said air transfer unit comprises:

a first portion positioned on one side of the interior structure of the building, said first portion having first connecting means for connecting said first portion to said conduit;

a second portion positioned on the other side of the interior structure of the building;

second connecting means on said first portion for connecting said first portion to said second portion; and third connecting means on said second portion for engaging said second connecting means.

16. The system according to claim 15, wherein said second connecting means comprises a male threaded portion and said third connecting means comprises a female threaded portion on said second portion, said female threaded portion being capable of receiving said male threaded portion to connect said second portion to said first portion.

17. The system according to claim 15, wherein said second portion includes filtration means for filtering particulate matter from the warm fluid extracted from the interior of the building by said pump.

18. The system according to claim 15, wherein said second portion includes a manually operable valve for opening and closing communication between said conduit and the interior of the building.

19. The system according to claim 1, further comprising at least one filter element secured within the opening of said channel of each said edge member.

20. A system for preventing the formation of ice dams and the buildup of ice and snow along the roof edge of a building of the type having a warm fluid source, the system comprising:

a plurality of edge members securable along the edge of the roof of the building, each of said edge members being formed of a heat conductive material, and having an upper portion securable to the roof of the building and a lower portion integrally depending from said upper portion, said lower portion being configured to define an elongate channel that opens downwardly while said upper portion is secured to the roof of the building, said lower portion having a first lip formed at one side of said channel intermediate said channel and said upper portion and a second lip formed at the other side of said channel, said first lip having a tip that extends downwardly below the opening of said channel while said upper portion is secured to the roof of the building and said second lip extending downwardly to a terminal end;

a fluid conducting member positioned in said channel of each said edge member, said fluid conducting member having a plurality of ports for expelling the fluid conducted therein;

first support means on each said edge member for supporting said channel under weight of the snow and ice;

second support means on each said edge member for supporting said upper portion under weight of the snow and ice; and fluid transfer means, communicating between the warm fluid source and each said fluid conducting member, for transferring the warm fluid from the warm fluid source to each said fluid conducting member;

wherein said ports of each said fluid conducting member expel the warm fluid into said channel, warming each said edge member to cause the ice dams and the snow and ice buildup thereon to melt, whereby the resulting water runoff flows off each said edge member.

* * * * *